US005537301A

United States Patent [19]

Martich

[11] Patent Number: 5,537,301

[45] Date of Patent: Jul. 16, 1996

[54] FLUORESCENT LAMP HEAT-DISSIPATING APPARATUS

[75] Inventor: Mark E. Martich, Hanover, Mass.

[73] Assignee: Pacific Scientific Company, Weymouth, Mass.

[21] Appl. No.: 300,423

[22] Filed: Sep. 1, 1994

[51] Int. Cl.[6] ..... F21V 29/00

[52] U.S. Cl. ..... 362/218; 362/226; 362/294; 362/363; 362/373; 313/36; 313/493

[58] Field of Search ..... 313/36, 44, 493; 362/218, 294, 373, 216, 217, 363, 226

[56] References Cited

U.S. PATENT DOCUMENTS

| | | | |
|---|---|---|---|
| 2,505,112 | 4/1950 | Hallman | 362/260 |
| 2,551,710 | 5/1951 | Slaughter | 362/218 |
| 2,966,602 | 12/1960 | Waymouth et al. | 313/44 |
| 3,112,890 | 12/1963 | Snelling | 362/373 |
| 3,965,345 | 6/1976 | Fordsmand | 362/218 |
| 3,974,418 | 8/1976 | Fridrich | 362/218 |
| 4,349,864 | 9/1982 | Smith | 362/218 |
| 4,363,083 | 12/1982 | Tanaka et al. | 362/373 |
| 4,393,323 | 7/1983 | Hubner | 362/223 |
| 4,423,348 | 12/1983 | Greiler | 362/373 |
| 4,871,944 | 10/1989 | Skwirut et al. | 313/493 |
| 5,174,646 | 12/1992 | Siminovitch et al. | 362/218 |

*Primary Examiner*—Denise L. Gromada
*Assistant Examiner*—Alan B. Cariaso
*Attorney, Agent, or Firm*—Lahive & Cockfield

[57] ABSTRACT

A fluorescent lamp dissipates heat from the lamp tube to a vented air stream within a lamp globe and to ambient air outside of the lamp. The lamp apparatus includes a base that mounts and provides electric current to a fluorescent illumination tube, a vented lamp globe and a thermally conductive heat dissipater engaged with the illumination tube. The heat dissipater thermally conducts heat from the illumination tube and transfers the heat to an air current within the lamp globe. A mounting element mounts the lamp globe and the heat dissipater with the base.

20 Claims, 3 Drawing Sheets

FLUORESCENT LAMP HEAT-DISSIPATING APPARATUS

TECHNICAL FIELD

This invention relates to fluorescent lamps, and more particularly to fluorescent lamps which have a heat-dissipating element for cooling the fluorescent tube. A preferred embodiment of the lamp has a dome or globe, and the heat-dissipating element limits the temperature increase of the fluorescent tube(s) within the globe.

BACKGROUND

Compact fluorescent lamps are widely used in residential and commercial applications. Their energy efficiency, compact size, high light output and relatively cool operation make them ideal replacements for both incandescent lamps and for bulky fluorescent lamps.

A fluorescent lamp has an illumination efficiency, in terms of light output, which is sensitive to the lowest temperature of the wall of the fluorescent tube. In particular, it is known that a fluorescent lamp operates with maximal illumination efficiency when the lowest temperature on the wall of a fluorescent tube, termed the cold spot, within a specific temperature range. This temperature range is understood to be between approximately 25° C. and 55° C., and if the minimum tube wall temperature is outside this range, the illumination efficiency decreases.

For reasons of safety and of esthetics, it is desirable often to employ a protective dome or globe over the illumination tube or tubes of a compact fluorescent lamp. Such a protective globe can be rigid and light-transmissive, and can protect the brittle illumination tubes from shock and breakage. The globe can also soften the illumination, e.g., by providing diffusion or prismatic reflection.

However, providing a protective globe on a fluorescent lamp can increase the operating temperature of the fluorescent tube or tubes therein, by restricting the heat-dissipation from each fluorescent tube. The resultant fluorescent tube operating temperature can then exceed the range for optimum illumination efficiency, which is undesirable.

U.S. Pat. No. 5,174,646 to Siminovitch et al. discloses a heat transfer structure for reducing the minimum wall temperature of a fluorescent tube, including when used with a protective enclosure. The disclosed heat transfer structure is in thermal contact with the fluorescent tube and removes heat from the tube wall by thermal conduction.

It is an object of this invention to provide a fluorescent lamp having a globe, or for use with a globe and which can dissipate sufficient heat to maintain the fluorescent tube operating at a temperature of high illumination efficiency. Another object of the invention is to provide a compact fluorescent lamp having a thermal dissipation element of the above character and which allows for ready installation and replacement of a fluorescent tube.

Further objects of the invention are to provide compact fluorescent lamp apparatus of the above character that can be manufactured and fabricated at relatively low cost and with an attractive appearance.

Other objects of the invention will in part be obvious and will in part appear hereinafter.

SUMMARY OF THE INVENTION

Fluorescent lamp apparatus according to this invention dissipates heat from each fluorescent tube to maintain the minimum tube wall temperature within an optimum temperature range and thus attains maximal lamp illumination efficiency. The lamp apparatus is well suited for use with a lamp dome or globe.

The invention attains the foregoing and other objects by providing a heat dissipater that engages a fluorescent tube to conduct heat from it and that can dissipate the heat to air both within and outside of a globe or dome that essentially encloses the fluorescent tube. The heat dissipater can be configured in different forms to cool a lamp having one, two, three or other numbers of fluorescent tubes. Further, the dissipater can readily be installed on and removed from a fluorescent lamp. Hence, by way of example, a fluorescent tube can be installed, and can be replaced, in a lamp having the dissipater.

The dissipater, according to the invention, has a resilient conductive structure that resiliently engages each fluorescent tube of the lamp. A thermally conductive element of the dissipater is in a high heat exchange relationship with the bulb-engaging element and conducts heat to an outside surface of the lamp, even when a bulb or globe is fitted with the lamp.

A further feature of the invention is to provide a fluorescent lamp having the heat dissipater discussed above with further structure that establishes a convection air current within the lamp globe or dome. The convention current cools the heat dissipater, even when the globe essentially fully encloses the fluorescent tube(s) of the lamp.

Fluorescent lamp apparatus according to one specific embodiment of the invention includes a base that mounts, and applies electric current to, one or more fluorescent illumination tubes. A lamp globe that encloses the illumination tube(s) is elongated between a mounting end and a distal end and has a first vent aperture at the distal end. A further vent aperture is provided for the passage of ambient air into the lamp globe near the mounting end of the globe. A heat dissipater removably and replaceably engages with each illumination tube within the lamp globe and transfers heat from each illumination tube to an air current created within the lamp globe between the vent apertures and hence, between the globe mounting end and the distal end. The lamp globe and the heat dissipater are commonly mounted with the lamp base in a self-supporting assemblage.

According to another feature of the invention, the heat dissipater has a heat receiving portion and a heat discharge portion. The two portions are inter-connected for high thermal conduction therebetween. The heat receiving portion engages with each fluorescent tube of a lamp, within the lamp globe, and receives heat from each fluorescent tube by thermal conduction. The heat receiving portion has a resilient spring structure to removably and replaceably engage with a fluorescent tube with a resilient contact pressure. In one specific embodiment, the spring structure includes plural resilient thermally-conductive finger-like contacts. Another specific embodiment employs a coil spring structure that circumferentially engages with each fluorescent tube of the lamp.

The heat discharge portion of the dissipater is in high thermal conduction with the heat receiving portion and, further, is disposed at least in part external to the lamp globe and external to the lamp base for dissipating heat to ambient air outside the globe. Further, the heat discharge portion of the heat dissipater is openly exposed to air currents interior of the lamp globe for dissipating heat to such air currents. One embodiment of the heat dissipater has a mounting bracket which seats the heat dissipater on the lamp base and which mountingly seats the lamp globe. The bracket is thermally conductively coupled with the heat receiving portion of the dissipater and functions at least in part as the heat discharge portion.

The invention accordingly comprises the features of construction, combinations of elements and arrangements of parts exemplified in the constructions hereinafter set forth, and the scope of the invention is indicated in the claims.

BRIEF DESCRIPTION OF THE DRAWINGS

For a fuller understanding of the nature and objects of the invention, reference is to be made to the following detailed description and the accompanying drawings in which.

DESCRIPTION OF THE ILLUSTRATED EMBODIMENTS

A heat dissipating fluorescent lamp according to the invention provides heat transfer from each fluorescent tube of the lamp to the ambient air. The lamp incorporates a heat dissipater suited for mounting within a lamp globe to establish a relatively high rate of heat transfer from each fluorescent tube to air within the globe and to air external to the globe. Further, when fitted with a vented globe, the structure establishes a convection air flow within the globe. These features enable a lamp according to the invention, even when fitted with a globe, to provide relatively high levels of illumination, with each fluorescent tube operating well within the range of maximal illumination efficiency.

Figure 1:
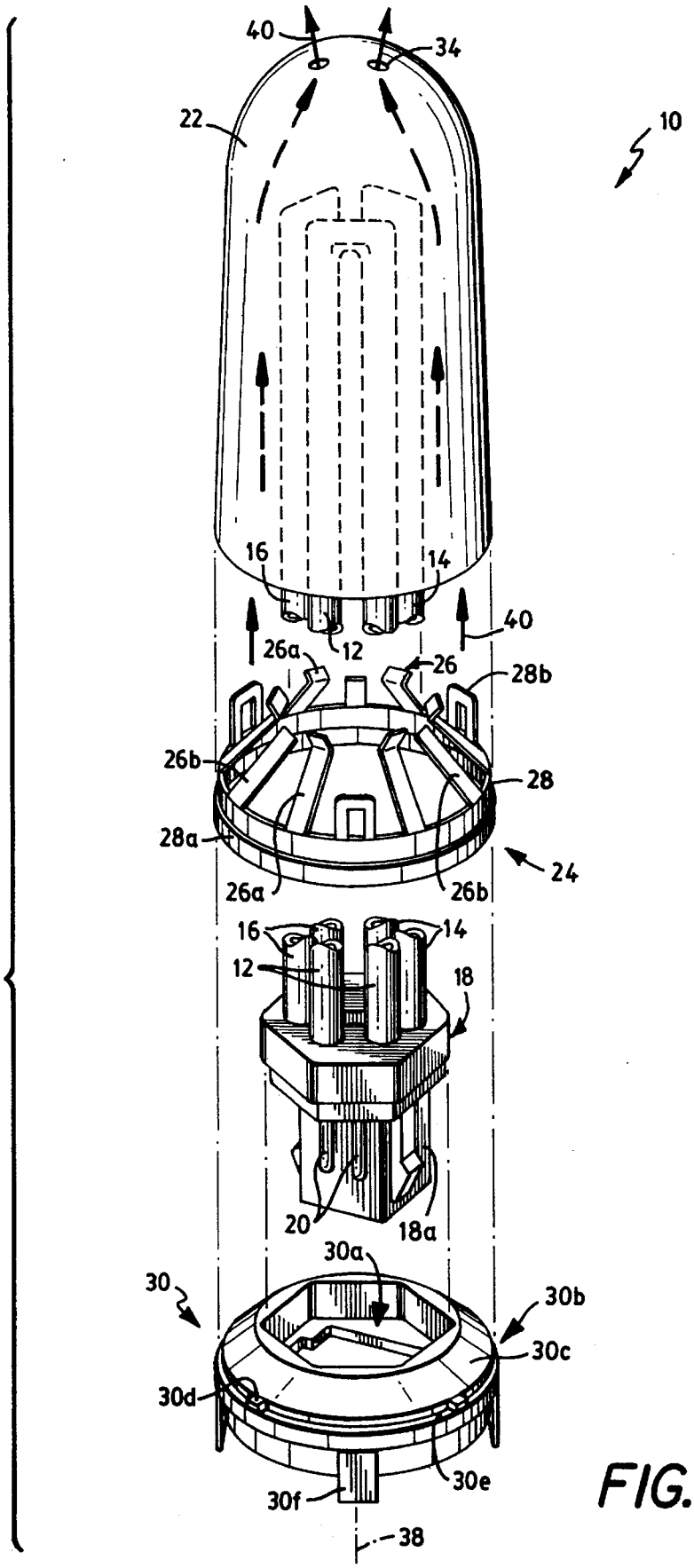
FIG. 1 is an exploded perspective view of a fluorescent lamp according to the invention.

Referring more particularly to FIG. 1, a fluorescent lamp 10 according to the invention has three compact fluorescent illumination tubes 12, 14 and 16, each mounted with a base 18 and receiving electrical current applied to the lamp by way of the base-carried electrical contacts 20. A translucent protective lamp globe 22 encloses the illumination tubes.

A thermally conductive heat dissipater 24 has a spring element 26, formed with multiple spring fingers **26*a*, that engages each tube 12, 14 and 16 within the globe 22. The dissipater 24 further has a transfer element 28, illustrated as including a mounting ring, that extends at least partially to the outer surface of the lamp 10**.

As further shown in FIG. 1, a mounting adapter 30 mountingly seats the base 18, with the fluorescent tubes 12, 14 and 16, in a central seat **30*a* and mountingly seats the heat dissipater 24 at an outer rim 30*b*. The heat dissipater 24 in turn mounts the globe 22. Each part 18, 22, 24 and 30** can be disassembled and reassembled from the others and hence the foregoing mountings are each removable and replaceable.

Figure 2:
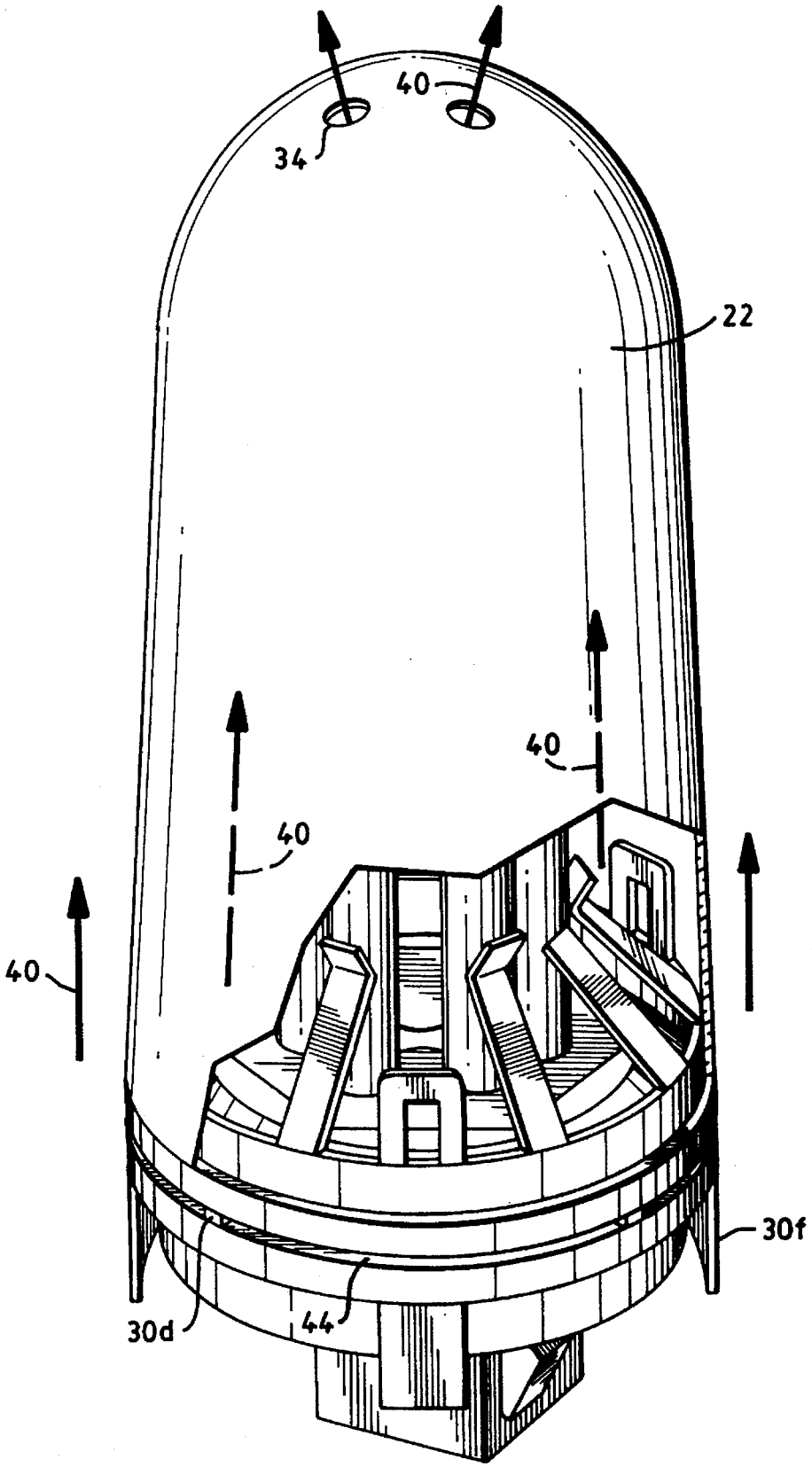
FIG. 2 shows the lamp of FIG. 1 in assembled form, partly broken away.
Figure 3:
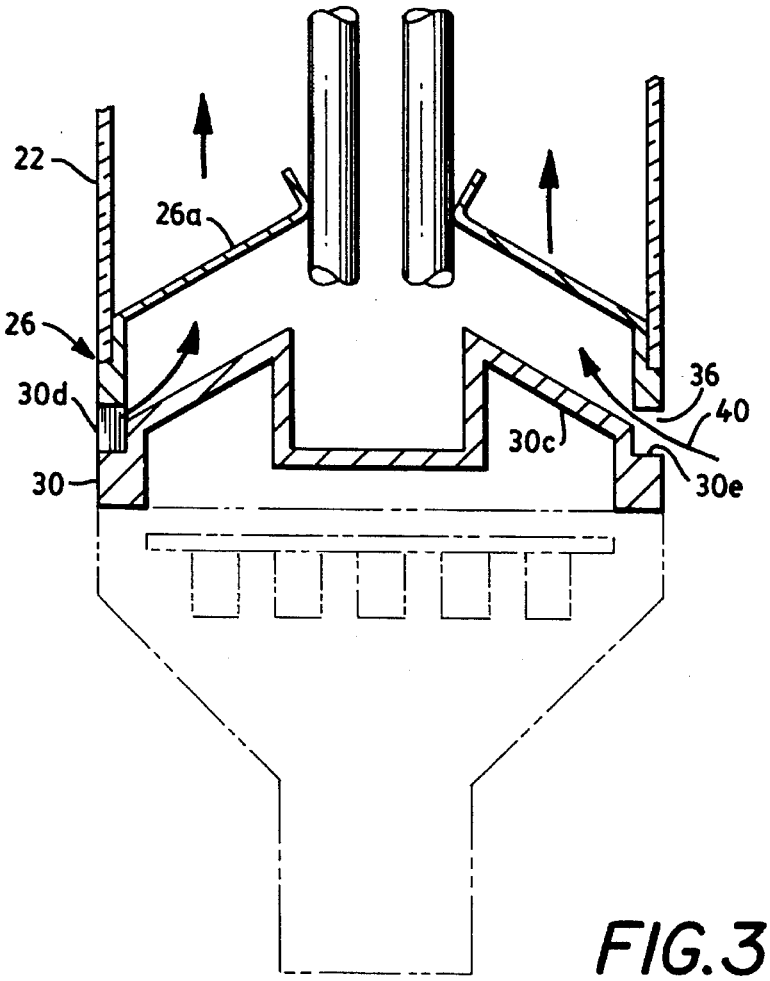
FIG. 3 is a fragmentary sectional view of the assembled lamp of FIG. 2.

The assembled lamp 10, FIGS. 2 and 3, has vent apertures 34 and 36 spaced apart along the lamp axis 38 for supporting air convection within and axially through the globe 22, particularly when oriented upright as shown. This convection, indicated with arrows 40, traverses the heat dissipater 24 and accordingly carries heat from the dissipater outward of the globe 22.

The transfer element 28 of the heat dissipater is externally openly exposed on the assembled lamp and transfers heat it receives from within the globe 22 outwardly to the ambient air, both by radiation and by conduction to ambient air currents external to the lamp globe.

The vent apertures 34 are at the otherwise closed end of the lamp globe 22, i.e., at the axial end of the globe 22 distal from the mounting end. The other vent apertures 36 are proximal to the mounting end of the lamp globe 22 and are formed by axial spaces or axially extending gaps 44 between the heat dissipater 24 and the mounting adapter 30.

With further reference to FIGS. 1 and 2, the lamp 10 is illustrated as having three fluorescent tubes 12, 14 and 16. The invention can however be practiced with a lamp having a single tube, two tubes or more than three fluorescent tubes. Each illustrated fluorescent tube is of the compact folded structure, as commercially available. Further, the illustrated base 18 is a commercially available component and is of electrically insulating material except for the electrical contacts 20 and the electrical connections within the base between the contacts 20 and the terminals of each fluorescent tube 12, 14 and 16.

The mounting adapter 30, typically of electrically insulating material, has an axially recessed and apertured central seat **30*a* that mountingly receives a plug portion 18*a* of the base 18. The seat 30*a* and the base plug portion 18*a* are correspondingly keyed or otherwise configured to assemble with a selected alignment. An annular web 30*c* of the adapter spans radially between the outer rim 30*b* and the central seat 30*a***.

The adapter outer rim **30*b* has an axially stepped configuration. Axial projections 30*d* circumferentially spaced around the stepped rim seatingly receive the transfer element 28 of the heat dissipater 24 to mount the heat dissipater to the adapter, and to space the transfer element axially from the radial lip or annulus 30*e* of the stepped ring. This axial spacing forms the axial gap 44 that provides the vent apertures 36**.

The illustrated mounting adapter 30 has a circular periphery at the rim **30*b* and has mounting prongs 30*f* circumferentially spaced apart and axially extending downward, below the web 30*c* and the ring 30*b* for mounting the adapter and thereby the lamp 10 to a further housing or support, such as a lamp housing having a threaded base as in conventional or incandescent bulbs and as shown in phantom in FIG. 3**.

Another lamp with which the invention can be practiced has a housing that combines the illustrated base 18 and adapter 30, and that contains the lamp ballast or other circuitry for driving the fluorescent tubes. This and like alternative constructions of the elements denoted as the base 18 and the adapter 30 are within the scope of this invention. Each such construction forms a base structure with which the heat dissipater of the invention mounts, either directly or indirectly.

With further reference to FIGS. 1 and 2, the illustrated lamp globe 22 is of an optically translucent or selectively transmissive and durable material, examples of which are glass and polycarbonate. It has a circular opening at the axial end distal from the vent apertures 34 for mounting to the adapter 30, illustratively by way of the heat dissipater 24.

The heat dissipater 24 of FIGS. 1 and 2 is a thermally conductive structure, typically of metal although other materials can be used, which removably and replaceably engages with each illumination tube 12, 14 and 16 of the lamp 10 within the globe 22 and which extends at least in part outside of the globe 22. The dissipater 24 transfers heat from each fluorescent tube to air within the globe and to ambient air external to the globe. Further, the structure of the heat dissipater 24 allows air convection, indicated with arrows 40, to pass axially within the globe 22 past the dissipater with relatively low obstruction and yet with significant transfer of heat from the dissipater to the air stream. The heat dissipater 24 thus transfers heat away from each fluorescent tube, principally by thermal conduction at the contact of the dissipater with the tube wall, and dissipates heat both within the globe 22 and external of the globe 22.

As shown in FIG. 1, the illustrated heat dissipater 24 is constructed with a ring-like transfer element 28 that matingly seats on the adapter 30. An outer tubular wall 28*a* of the dissipater is external on the assembled lamp for dissipating heat to the ambient air and can be finned or otherwise structured to enhance heat transfer from the dissipater to the air external of lamp 10. The mounting end of the globe 22 seats axially on the wall 28*a*. Circumferentially spaced prongs 28*b* extend axially from the tubular wall 28*a* and seat within the globe 22 for secure mounting.

The spring element 26 of the illustrated heat dissipater 24 has fingers 26*a* that project from the ring-like transfer element radially inward, and axially. The fingers 26*a* are circumferentially spaced about the ring-like structure for engaging the wall of each tube 12, 14 and 16 for conductive heat transfer therewith. The illustrated heat dissipater 24 further has alignment followers 26*b*, circumferentially spaced between the fingers 26*a*, which fit between adjacent lengths of the fluorescent tubes, to align the dissipater 24 rotationally so that each finger 26*a* fully engages a fluorescent tube.

The heat dissipater 24 can readily be assembled axially onto the fluorescent tubes 12, 14 and 16 mounted on the base 18. Where each tube is replaceable and where desired, any or all tubes can be replaced relative to the dissipater.

The heat dissipater fingers 26*a* and the followers 26*b*, which preferably are also of thermally conductive material, are openly exposed to convection current within the globe for the high transfer of heat to the convecting air. Further, the fingers 26*a* conduct heat from their contact with the fluorescent tubes to the externally exposed transfer element 28. In one preferred practice, the fingers 26*a* are formed integrally with the transfer element 28 for high thermal conductivity therewith.

Figure 4:
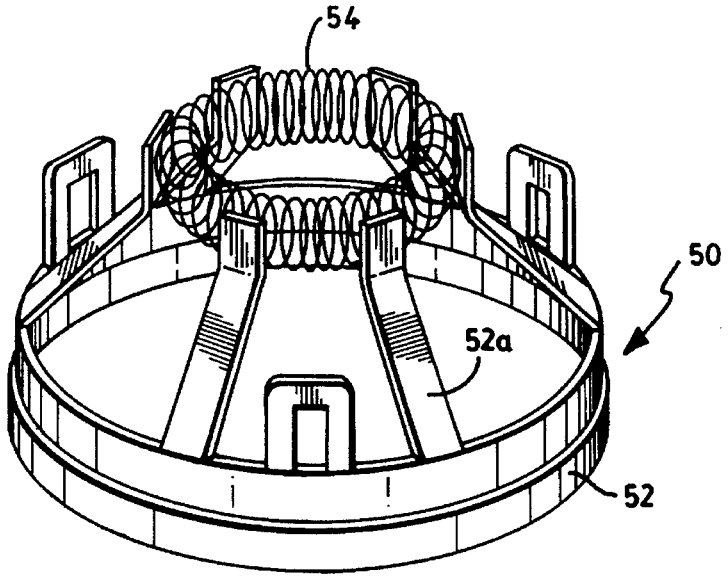
FIG. 4 shows an alternative structure of a heat dissipater according to the invention.

FIG. 4 shows another construction for a heat dissipater 50 further in accord with the invention and for use in a lamp such as the lamp 10 of FIG. 1, in place of the heat dissipater 24 of FIGS. 1 and 2. The heat dissipater 50 has a transfer element 52 essentially identical to the transfer element 28 of the heat dissipater 24 of FIGS. 1 and 2. It further has a spring element 54 that includes a coil spring formed into a torus and mounted to the transfer element, both for support and for conductive heat transfer therebetween, by way of circumferentially spaced mounting ribs 52*a*. The mounting ribs 52*a* and the toroidal coil spring are sufficiently resiliently flexible to seat the spring circumferentially around the assembled fluorescent tubes, e.g., the tubes 12, 14 and 16 in FIGS. 1 and 2, of a lamp with resiliently compressive engagement therewith for heat transfer.

When the assembled lamp 10 is oriented upright as shown in FIGS. 1 and 2, and the fluorescent tubes are turned on for illumination, the heat produced by the lamp tubes creates a convection flow of air, as indicated by the arrows 40, 40 within the globe 22. Ambient air enters the globe adjacent the mounting end by way of the vent apertures 36 (FIG. 3), and exits from the globe by way of the vent apertures 34. The resultant convection flow cools the fluorescent tubes 12, 14 and 16 and cools the dissipater 24, particularly the fingers 26*a* of the spring element. The resultant cooling of each lamp tube, at least at the engagement with the dissipater spring element, attains a cool spot on the tube with a temperature within the range desired for maximal lighting efficiency. The spring element of each illustrated dissipater 24 and 50 engages the fluorescent tubes of the lamp at locations proximal to the seating of the globe 22, i.e., proximal to the base 18, and hence proximal to the vent apertures 36. In one lamp according to the invention, the illustrated embodiment of FIGS. 1 and 2 maintained a cool spot on each tube, is a location of minimal temperature, at approximately 40° C. This temperature is near the mid-point of the range of minimum temperatures of maximal operating efficiency.

It will thus be seen that the invention efficiently obtains the objects set forth above, among those made apparent from the preceding description. Since certain changes may be made in the above constructions without departing from the scope of the invention, it is intended that all matter contained in the above description or shown in the accompanying drawings be interpreted as illustrative and not in a limiting sense.

It is also to be understood that the following claims are intended to cover all generic and specific features of the invention herein described, and all statements of the scope of the invention which, as a matter of language, might be said to fall therebetween.

Having described the invention, what is claimed as new and secured by Letters Patent is:

1. In fluorescent lamp apparatus having a base that mounts, and applies electrical current to, a fluorescent illumination tube, the improvement comprising a lamp globe for enclosing the fluorescent illumination tube and elongated between a mounting end and a distal end having a first vent aperture, a heat dissipater in engagement with the fluorescent illumination tube within the lamp globe for conducting heat from the fluorescent illumination tube and for transferring heat to an air current within the lamp globe between the mounting end and the first vent aperture, and means for mounting the lamp globe and the dissipater with the base and for providing a second vent aperture for the passage of ambient air into the lamp globe proximal to the mounting end.

2. In fluorescent lamp apparatus according to claim 1, the further improvement wherein said mounting means includes a bracket for mountingly seating with at least one of said base and said lamp globe and supportingly attached to said heat dissipater.

3. In fluorescent lamp apparatus according to claim 1, the further improvement wherein said heat dissipater includes a heat transfer element for receiving by thermal conduction heat conducted to said dissipater from the fluorescent illumination tube and for transferring said heat to ambient air.

4. In fluorescent lamp apparatus according to claim 1, the further improvement wherein said heat dissipater includes a heat receiving portion in engagement with the fluorescent illumination tube within the lamp globe for receiving by conduction heat from the fluorescent illumination tube, and a heat discharge portion thermally conductively coupled with the heat receiving portion for dissipating heat therefrom to ambient air.

5. In fluorescent lamp apparatus according to claim 1, the further improvement wherein the heat dissipater is in removable and replaceable engagement with the fluorescent illumination tube.

6. In fluorescent lamp apparatus according to claim 1, the further improvement wherein the heat dissipater is in resiliently compressive engagement with the fluorescent illumination tube.

7. In fluorescent lamp apparatus according to claim 1, the further improvement wherein the heat dissipater includes at least one resilient member removably and replaceably engaged with the fluorescent illumination tube.

8. In fluorescent lamp apparatus according to claim 7, the further improvement wherein the heat dissipater includes coil spring means circumferentially disposed around and engaged with the fluorescent illumination tube.

9. In fluorescent lamp apparatus according to claim 1, the further improvement wherein the heat dissipater includes a mounting bracket portion for seating the heat dissipater on the base.

10. In fluorescent lamp apparatus according to claim 4, the further improvement wherein the heat dissipater includes a mounting bracket portion for seating the heat dissipater on the base, and wherein the bracket portion is thermally conductively coupled with at least one of the heat discharging portion and the heat receiving portion of the heat dissipater.

11. In fluorescent lamp apparatus having a base that mounts and applies electrical current to a fluorescent illumination tube, the improvement comprising a heat dissipater in removable and replaceable engagement with the fluorescent illumination tube for conducting heat from the fluorescent illumination tube and for transferring heat to an air current proximal to the fluorescent illumination tube, said heat dissipater further including means for maintaining a portion of the illumination tube at a temperature within a selected temperature range to attain maximal lamp efficiency, and means for mounting a lamp globe and the heat dissipater with the base and for providing a vent aperture for the passage of ambient air into a lamp globe proximal to the mounting thereof.

12. Fluorescent lamp apparatus for dissipating heat from within a lamp tube thereof, comprising a base that mounts and applies electric current to a fluorescent illumination tube, a lamp globe for enclosing the fluorescent illumination tube and having a mounting end and having a first vent aperture therethrough, a heat dissipater in removable and replaceable engagement with the fluorescent illumination tube within the lamp globe for conducting heat from the fluorescent illumination tube and for transferring heat to an air current within the lamp globe between the mounting end and the first vent aperture, and means for mounting the lamp globe and the dissipater with the base and for providing a second vent aperture for the passage of ambient air into the lamp globe proximal to the mounting end.

13. In fluorescent lamp apparatus having a base that mounts, and applies electrical current to, a fluorescent illumination tube, the improvement comprising a vented lamp globe for enclosing the fluorescent illumination tube and having a mounting, and a heat dissipater of thermally conductive material in removable and replaceable engagement with the fluorescent illumination tube within the lamp globe for conducting heat from the fluorescent illumination tube and for dissipating heat therefrom to air external to the globe, said dissipater being arranged for mounting with the lamp globe and with the base.

14. In fluorescent lamp apparatus having a base that mounts, and applies electrical current to, a fluorescent illumination tube, the improvement comprising a lamp globe for enclosing the fluorescent illumination tube and elongated between a mounting end and a distal end having a first vent aperture, a heat dissipater in engagement with the fluorescent illumination tube within the lamp globe for conducting heat from the fluorescent illumination tube and for transferring heat to an air current within the lamp globe between the mounting end and the first vent aperture, said heat dissipater includes a heat transfer element disposed at least in part external to said globe and external to said base for the transfer of heat therefrom to ambient air, said heat transfer element receiving by thermal conduction heat conducted to said dissipater from the fluorescent illumination tube, and means for mounting the lamp globe and the dissipater with the base and for providing a second vent aperture for the passage of ambient air into the lamp globe proximal to the mounting end.

15. In fluorescent lamp apparatus having a base that mounts, and applies electrical current to, a fluorescent illumination tube, the improvement comprising a lamp globe for enclosing the fluorescent illumination tube and elongated between a mounting end and a distal end having a first vent aperture, a heat dissipater in engagement with the fluorescent illumination tube within the lamp globe for conducting heat from the fluorescent illumination tube and for transferring heat to an air current within the lamp globe between the mounting end and the first vent aperture, said heat dissipater includes a heat receiving portion in engagement with the fluorescent illumination tube within the lamp globe for receiving by conduction heat from the fluorescent illumination tube, and a heat discharge portion thermally conductively coupled with the heat receiving portion and disposed at least in part external to the lamp globe and external to the base for dissipating heat therefrom to ambient air, and means for mounting the lamp globe and the heat dissipater with the base and for providing a second vent aperture for the passage of ambient air into the lamp globe proximal to the mounting end of the globe.

16. In fluorescent lamp apparatus according to claim 15, the further improvement wherein the heat dissipater further includes a mounting bracket portion for seating the heat dissipater on the base and for mountingly seating the lamp globe on the heat dissipater, and wherein the bracket portion is thermally conductively coupled with at least one of the heat discharging portion and the heat receiving portion of the heat dissipater.

17. In fluorescent lamp apparatus having a base that mounts, and applies electrical current to, a fluorescent illumination tube, the improvement comprising a lamp globe for enclosing the fluorescent illumination tube and elongated between a mounting end and a distal end having a first vent aperture, a heat dissipater in engagement with the fluorescent illumination tube within the lamp globe for conducting heat from the fluorescent illumination tube and for transferring heat to an air current within the lamp globe between the mounting end and the first vent aperture, wherein the heat dissipater includes at least one resilient member removably and replaceably engaged with the fluorescent illumination tube, and coil spring means circumferentially disposed around and engaged with the fluorescent illumination tube, and means for mounting the lamp globe and the dissipater with the base and for providing a second vent aperture for the passage of ambient air into the lamp globe proximal to the mounting end.

18. In fluorescent lamp apparatus according to claim 11 wherein said selected temperature range is between about 25° C. and about 55° C.

19. In fluorescent lamp apparatus according to claim 1 wherein said heat dissipater further includes means for maintaining at least a portion of said illumination tube at a temperature within a selected temperature range to attain maximal lighting efficiency.

20. In fluorescent lamp apparatus according to claim 19 wherein said selected temperature range is between about 25° C. and about 55° C.

* * * * *